US006123337A

United States Patent [19]

Fang et al.

[11] Patent Number: 6,123,337

[45] Date of Patent: Sep. 26, 2000

[54] COMPOSITE EARTH BORING BIT SEAL

[75] Inventors: Zhigang Fang; Sujian Huang; Chris E. Cawthorne, all of The Woodlands; Brian A. James, Houston; G. Steve Kyker, Big Sandy; Robert Denton, Pearland, all of Tex.; Roger Didericksen, Ponca City, Okla.

[73] Assignee: Smith International, Inc., Houston, Tex.

[21] Appl. No.: 08/980,917

[22] Filed: Dec. 1, 1997

Related U.S. Application Data

[63] Continuation-in-part of application No. 08/727,001, Oct. 8, 1996, Pat. No. 5,842,700.

[51] Int. Cl.[7] ..... F16J 15/16; E21B 33/10

[52] U.S. Cl. ..... 277/336; 277/584; 277/589; 277/910; 277/936

[58] Field of Search ..... 277/336, 407, 277/440, 441, 500, 569, 584, 589, 910, 936, 944; 384/94; 175/371, 372

[56] References Cited

U.S. PATENT DOCUMENTS

| | | | |
|---|---|---|---|
| 2,360,735 | 10/1944 | Smith | 277/177 |
| 2,926,976 | 3/1960 | Bowerman et al. . | |
| 2,953,398 | 9/1960 | Haugen et al. . | |
| 3,049,385 | 8/1962 | Smith . | |
| 3,746,405 | 7/1973 | Welton . | |
| 3,778,654 | 12/1973 | Hueschen et al. . | |
| 3,918,726 | 11/1975 | Kramer . | |
| 4,194,748 | 3/1980 | Farch et al. . | |
| 4,223,896 | 9/1980 | Ström . | |
| 4,280,709 | 7/1981 | Heikes, Jr. et al. . | |
| 4,552,233 | 11/1985 | Klima . | |
| 4,557,609 | 12/1985 | Morén . | |
| 4,776,599 | 10/1988 | Vezirian | 277/95 |
| 5,323,863 | 6/1994 | Denton | 277/227 |
| 5,362,073 | 11/1994 | Upton et al. . | |
| 5,441,120 | 8/1995 | Dysart . | |
| 5,509,670 | 4/1996 | Wheeler | 277/188 R |
| 5,513,711 | 5/1996 | Williams . | |
| 5,738,358 | 4/1998 | Kalsi et al. . | |

*Primary Examiner*—Anthony Knight
*Assistant Examiner*—John L. Beres
*Attorney, Agent, or Firm*—Christie Parker & Hale, LLP

[57] ABSTRACT

A high performance rock bit journal seal is formed from a composite material comprising an elastomeric material and a nonelastomeric polymeric material. The polymeric material is preferably in the form of fibers compiled or woven into a sheet. The elastomeric material may include one or more lubricant additives. The composite seal material comprises a number of repeating sheets of polymeric fabric that are bonded together with the elastomeric material. The seal can either be formed entirely of the composite seal material or partially of the composite material, in which case it is preferred that the seal wear or dynamic surface be formed from the composite material and the remaining portion of the seal be formed from an elastomeric material. The seal can be used as a primary journal seal, or as a secondary journal seal in a dual seal bit. Seals formed from the composite seal material display enhanced wear resistance, reduced coefficient of friction, and improved high-temperature stability and endurance when compared to noncomposite seal materials, thereby both extending the useful life of seals formed therefrom formed and of rock bits that employ such seals.

34 Claims, 10 Drawing Sheets

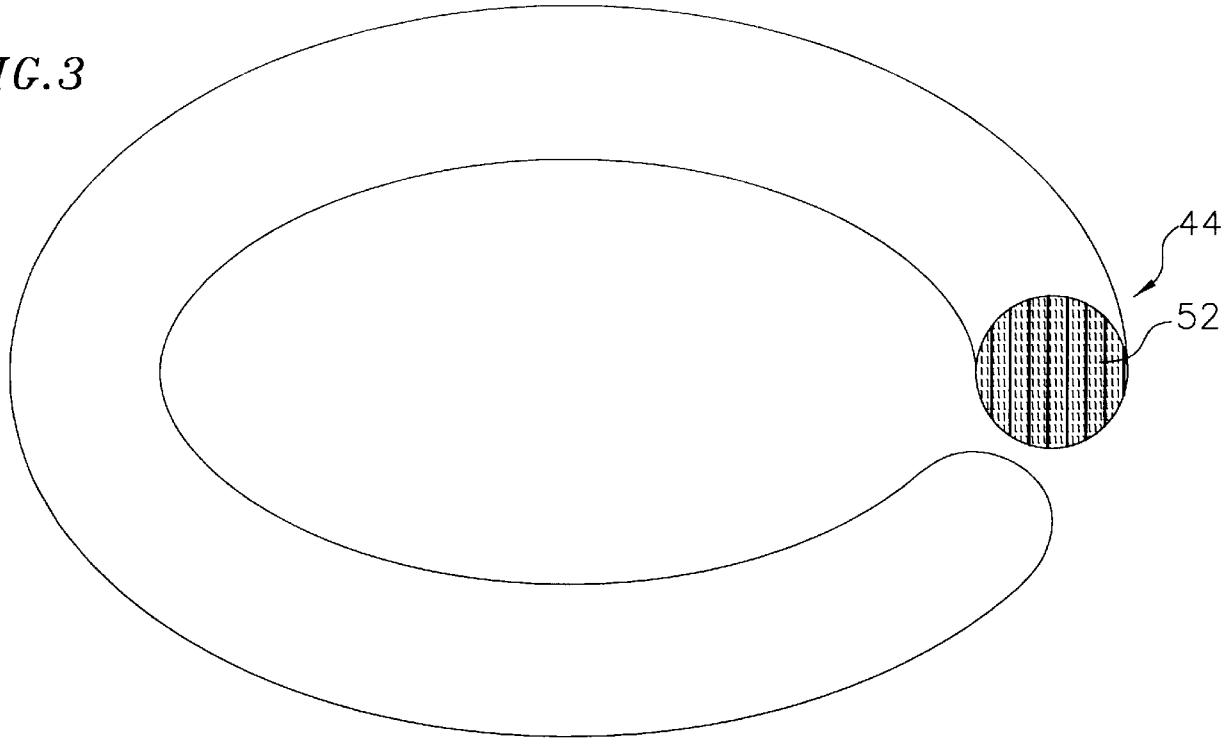
FIG.3
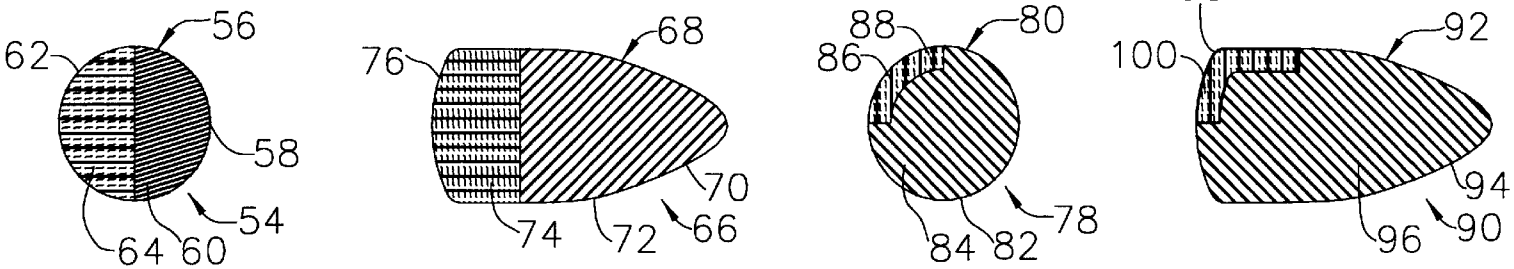
FIG.4
FIG.5
FIG.6
FIG.7

COMPOSITE EARTH BORING BIT SEAL

RELATION TO COPENDING APPLICATION

This patent application is a continuation-in-part of U.S. patent application Ser. No. 09/727,001 that was filed on Oct. 8, 1996, issued as U.S. Pat. No. 5,842,700 on Dec. 1, 1998, and which is incorporated herein by reference.

FIELD OF THE INVENTION

This invention relates to annular seals that are used for providing a seal within a rotary earth boring bit such as rock, mining, and drill bits used for drilling oil wells or the like. More particularly, this invention relates to annular seals constructed from a composite material that provide an improved degree of temperature and friction resistance, thereby enhancing the service life of both the seal and bit.

BACKGROUND OF THE INVENTION

Earth boring bits include rotary cone rock bits that are employed for drilling wells, blast holes, or the like in subterranean formations for oil, gas, geothermal steam, minerals, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and/or the bit body are rotated in the bore hole, and each cone is caused to rotate on its respective journal as the cone contacts the bottom of the bore hole being drilled. As such a rock bit is used for drilling deep wells where tough formations, high pressures and temperatures are encountered.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One cause of rock bit failure is due to severe wear that occurs on journal bearings on which the cutter cones are mounted. These bearings can be friction or roller-type bearings and can be subject to high drilling loads, high hydrostatic pressures in the hole being drilled, and high temperatures due to drilling, as well as elevated temperatures in the formation being drilled. The journal bearings are lubricated with grease adapted to such severe conditions. The grease is retained within the rock bit, to lubricate the journal bearings, by a seal. The seal is typically in the form of an annular ring and includes a dynamic seal surface, that is placed in rotating contact against a journal surface, and a static seal surface, that is placed in contact against a stationary or relatively stationary cone surface. The seal must endure a range of different temperature and pressure conditions at the dynamic and static seal surfaces during the operation of the rock bit to prevent the grease from escaping and/or contaminants from entering and, to thereby ensure that the journal bearings remain sufficiently lubricated.

Journal seals used in such earth boring bits are typically provided in the form of a single annular O-ring-type seal that is intended to provide an absolute or positive seal, and that is made entirely from rubber or other elastomeric material. The term "absolute" or "positive" seal is intended to mean that the seal is designed to fit within a complementary seal cavity to provide a leak-tight seal between the journal and cone surfaces, thereby prohibiting both leakage of grease from the bit and ingress or leakage of drilling fluid into the bit. It is desirable that a secondary seal be used in conjunction with a primary journal seal to reduce the amount of drilling debris or the like that can reach the primary seal. Such secondary seals perform the function of excluding passage of debris towards the primary seal.

Journal seals formed from such rubber or elastomeric materials display excellent sealing properties of elasticity and conformity to mating surfaces, they display poor tribiological properties, low wear resistance, a high coefficient of friction, and a low degree of high-temperature endurance and stability during operating conditions. Accordingly, the service life of rock bits equipped with such seals is defined by the limited ability of the elastomeric seal material to withstand the different temperature and pressure conditions at each dynamic and static seal surface.

U.S. Pat. No. 3,778,654 issued to Mandley discloses a multiple hardness O-ring comprising a seal body formed from nitrile rubber, and a hardened exterior skin surrounding the body that is formed by surface curing the exterior surface of the nitrile rubber. Although the patent teaches that the O-ring seal constructed in this manner displays improved hardness and abrasion resistance, the act of hardening the entire outside surface of the seal body causes the seal to lose compressibility and other related properties that are important to the seal's performance at the static seal surface.

U.S. Pat. No. 4,557,609 issued to Moren discloses a drill bit seal having a dynamic and static seal surface formed from different materials. The dynamic seal surface is formed from a relatively low friction material comprising Teflon that is deposited onto a inside diameter surface of the seal. The static seal surface is formed from the same material that is used to form the seal body. The Teflon surfaces acts to improve the wear resistance of the seal at the dynamic seal surface. However, the use of Teflon on the dynamic seal surface only provides a temporary improvement in wear resistance because it eventually wears away to uncover the relatively less wear resistant seal body.

U.S. Pat. No. 5,362,073 issued to Upton et al. discloses a composite rock bit seal comprising a dynamic seal surface, formed from a single type of elastomeric material, and has inner and outer static seal surfaces that are each formed from different elastomeric materials. The elastomeric materials used to form the static seal surface are less wear resistant than the elastomeric materials forming the dynamic seal surface. The materials forming the dynamic and static seal surfaces are bonded together by cross-linking to form the seal body. Although the seal provides a degree of improved wear resistance at the dynamic seal surface, it is still limited to what an elastomer can offer in terms of wear resistance, therefore the dynamic surface geometry will still be the point of failure of the seal.

It is, therefore, desired that a journal seal be constructed in a manner that displays sealing properties that are equal to or better than those of seals formed exclusively from elastomeric materials when used in sealing applications for an earth boring bit. It is also desired that the seal construction display improved tribiological properties, improved wear resistance, a reduced coefficient of friction, and improved high-temperature endurance and stability when compared to conventional journal seals formed exclusively from elastomeric materials.

SUMMARY OF THE INVENTION

There is, therefore, provided in practice of this invention, high performance journal seals, at least a portion of which or the entire seal being formed from composite materials comprising a nonelastomeric polymeric material, and an elastomeric material bonded to the polymeric material. The non-elastomeric polymeric material is preferably in the form of fibers that are compiled or woven into sheet form. The elastomeric material may include at least one lubricant additive. In a preferred embodiment, the seal is formed from a composite material comprising a number of repeating sheets of polymeric fabric bonded together with the elastomeric material.

In one embodiment, the seal includes a body that is formed entirely from the composite material, in which case both static and dynamic seal surfaces are formed from the same material. In another embodiment, the seal includes a first body portion formed from the composite material, and a remaining second body portion formed from a noncomposite elastomeric seal material. In such embodiment, it is preferred that the seal surface that is static relative to an adjacent bit surface be formed from the noncomposite material, and the wear surface of the seal that is dynamic be formed from the composite seal material to, thereby, enhance seal life at the dynamic surface. It is desired that the elastomeric material used to form the noncomposite and composite seal material be the same or chemically compatible with each other to facilitate cross linking between the static and dynamic seal surfaces to form a good bond therebetween.

Journal seals of this invention can be used as the primary seal in an earth boring bit, to prevent the leakage of grease therefrom or to prevent the ingress of drilling fluid and debris therein, and/or can be used as a secondary seal in a dual seal bit to exclude drilling fluid and debris and the like from reaching the primary seal.

Rock bit seals formed from the composite material of this invention display enhanced wear resistance, reduced coefficient of friction, and improved high-temperature stability and endurance when compared to noncomposite seal materials, thereby both extending the useful life of seals formed therefrom formed and of rock bits that employ such seals in either primary or secondary use.

BRIEF DESCRIPTION OF THE DRAWINGS

These and other features and advantages of the present invention will become appreciated as the same becomes better understood with reference to the specification, claims and drawings wherein:

FIG. 3 is a cross-sectional view of a first embodiment of a journal seal constructed according to the principles of this invention;

FIG.4 is a cross-sectional view of a second embodiment of a journal seal constructed according to the principles of this invention;

FIG. 5 is a cross-sectional view of a third embodiment of a journal seal constructed according to the principles of this invention;

FIG. 6 is a cross-sectional view of an alternative second embodiment of a journal seal constructed according to the principles of this invention;

FIG. 7 is a cross-sectional view of an alternative third embodiment of a journal seal constructed according to the principles of this invention;

DETAILED DESCRIPTION

Figure 1:
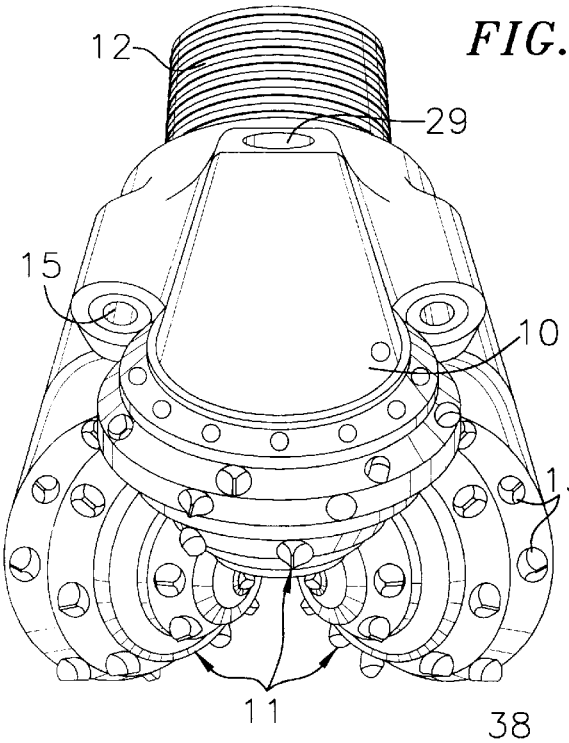
FIG. 1 is a semi-schematic perspective of a rock bit containing a journal seal constructed according to the principles of this invention.

Journal seals constructed according to principles of this invention are designed for use in earth boring bits such as rotary cone rock bits. FIG. 1 illustrates a rotary cone rock bit comprising a body 10 having a number of cutter cones 11 rotatably mounted on its lower end, as shown in FIG. 1. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Journal seals constructed according to principles of this invention can be embodied: (1) in the shape of an O-ring, comprising a circular inside and outside diameter, and having a circular cross section; (2) having a radial high-aspect ratio cross sectional geometry (i.e., the cross sectional radial width is greater than an axial width); or (3) having any other type of symmetrical or asymmetrical cross-sectional geometry. A key feature of journal seals of this invention is that they are constructed from a composite material comprising both non-elastomeric polymeric material and elastomeric materials.

Figure 2:
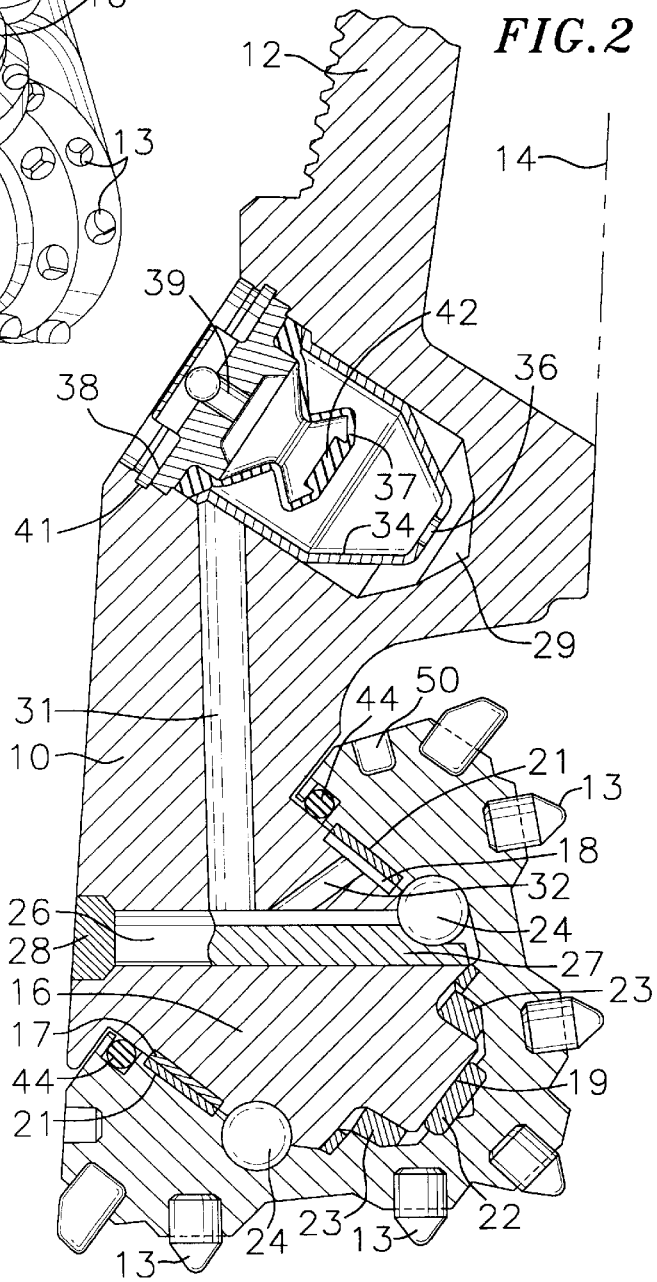
FIG. 2 is a partial cross-sectional view of a first rock bit embodiment comprising a journal seal constructed according to the principles of this invention.

FIG. 2 is a fragmentary, longitudinal cross-section of the rock bit of FIG. 1, extending radially from the rotational axis 14 of the rock bit through one of the legs on which the cutter cones 11 are mounted. For purposes of illustration and reference, the rock bit described and illustrated comprises three legs and three rotatably-mounted cones. Each leg includes a journal pin extending downwardly and radially outwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness than the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end. Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating inlay in a groove in the cone. The aluminum bronze inlay 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the journal bearings illustrated herein. It is to be understood that a journal seal constructed according to principles of this invention may be used with rock bits comprising either roller bearings or conventional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A weld deposit 28 is then welded into the end of the ball passage to keep the ball retainer in place. The bearing surfaces between the journal pin and the cone arc lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit.

The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of a journal seal 44 that is disposed within a seal cavity 46 interposed between the cone and journal pin. FIG. 2 illustrates a first rock bit embodiment that comprises a single journal seal that is used to provide a positive seal between the journal and cone to both prevent the escape of grease therefrom and prevent the migration of drilling fluid therein. In an alternative embodiment, the seal cavity 46 has a slightly ramped or V-shaped configuration to more closely contain the journal seal therein.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the journal seal 44 and permit drilling fluid or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the O-ring seal. Even with a pressure compensator, it is believed that occasional differential pressures may exist across the journal seal of up to 150 psi (550 kilopascals).

To maintain the desired properties of the journal seal at the pressure and temperature conditions that prevail in a rock bit, to inhibit "pumping" of the grease through the seal, and for a long useful life, it is important that the journal seal be resistant to crude oil and other chemical compositions found within oil wells, have a high heat and abrasion resistance, have low rubbing friction, and not be readily deformed under the pressure and temperature conditions in a well which could allow leakage of the grease from within the bit or drilling fluid into the bit.

Journal seals conventionally employed in rock bits are shaped in the form of an O-ring and are formed from noncomposite materials comprising elastomeric or rubber materials, such as acrylonitrile polymers or acrylonitrile/butadiene copolymers. Other components sometimes used in the polymers include activators or accelerators for the curing, such as stearic acid, and agents that improve the heat resistance of the polymer, such as zinc oxide and curing agents.

Synthetic rubbers used to form such seals typically exhibit poor heat resistance and are known to become brittle when exposed to elevated operating temperatures after extended periods of time, i.e., display poor high-temperature endurance and stability. Such compounds are also known to have undesirably low tensile strength and high coefficients of friction, and are not well suited for use in forming journal seals because of the high operating temperatures and aggressive wear that is know to occur in rock bits. Additionally, journal seals formed exclusively from elastomeric or rubber materials have also been found to have poor tribiological properties, further contributing to accelerated seal degradation during use.

Journal seals, constructed according to principles of this invention, are formed from a composite material comprising non-elastomeric polymeric materials and elastomeric or rubber materials. Seals formed from such composite material offers key advantages when compared to seals formed from noncomposite materials, such as those formed exclusively from elastomeric materials, due to the superior high-temperature endurance and stability, wear resistance, and reduced coefficient of friction afforded by the composite material.

It is to be understood that the polymeric material is nonelastomeric or "elastomer free" and that the terms polymeric material and nonelastomeric polymeric material shall be used interchangeably to mean the same thing. Nonelastomeric polymeric materials useful for forming the composite journal seal are preferably in the form of fibers that are known to have good properties of wear resistance and/or temperature resistance. Example polymeric materials include those selected from the group consisting of polyester fiber, cotton fiber, aromatic polyamides (Aramids) such as those available under the Kevlar family of compounds, polybenzimidazole (PBI) fiber, poly m-phenylene isophthalamide fiber such as those available under the Nomex family of compounds, asbestos fiber, and mixtures or blends thereof.

The fibers can be: (1) used in their independent state, e.g., as a random arrangement of fibers distributed within an elastomeric constituent of the seal; (2) combined in a random or unordered an-angement to form a felt sheet; (3) combined in an ordered or non-random arrangement to form a sheet; or (4) combined into threads and woven into a fabric to form a fabric sheet. When fabricated into sheet form, the fibers can be arranged to provide a desired tensile strength in one or more desired direction to meet particular application demands. Additionally, the same or differently oriented fabric sheets can be stacked upon one another to meet certain performance characteristics, e.g., the sheets can be ordered and stacked to provide properties of improved wear resistance in a particular direction.

Preferred nonelastomeric polymeric materials include those having a softening point higher than about 350° F., and having a tensile strength of greater than about 10 Kpsi. Other polymeric materials suitable for use in forming composite seals include those that display properties of high-temperature stability and endurance, wear resistance, and have a coefficient of friction similar to those polymeric materials specifically mentioned above. If desired, glass fiber can be used to stiffen the polymeric fiber, in such case constituting the core for the polymeric fiber. An exemplary nonelastomeric polymeric material is a polyester-cotton fabric having a density of approximately eight ounces per square yard. The polymeric material is provided in the form of a fabric sheet having a desired mesh size.

Suitable elastomeric materials useful for forming the seal construction include those selected from the group of fluoroelastomers including those available under the trade name Advanta manufactured by DuPont, carboxylated elastomers such as carboxylated nitrites, highly saturated nitrile (HISN) elastomers, nitrile-butadiene rubber (HBR), highly saturated nitrile-butadiene rubber (HNBR) and the like. Suitable elastomeric materials have a modulus of elasticity at 100 percent elongation of from about 500 to 2,000 psi (3 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 18 percent, and preferably less than about 16 percent. A preferred elastomeric material is a proprietary HSN manufactured by Smith International, Inc., under the product name HSN-8A.

Composite materials used to form seal constructions of this invention preferably comprise in the range of from 20 to 80 percent by volume polymeric material, and a remaining amount elastomeric material, based on the total volume of the composite material. A seal formed from a composite material comprising less than about 20 percent by volume of the polymeric material will not produce a desired degree of high-temperature stability and endurance, and wear resistance. A seal formed from a composite material comprising greater than about 80 percent by volume of the polymeric material will be too rigid and lack a desired degree of elasticity to act as a good seal material. More preferably, the composite material comprises in the range of from about 30 to 70 percent by volume polymeric material. A particularly preferred seal is formed from a composite material comprising approximately 50 percent by volume polymeric material. The seal construction preferably includes one or more lubricant additives, dispersed uniformly through the elastomeric material, to further reduce wear and friction along the surface of the seal. However, it is to be understood that seal construction of this invention can be made without such lubricant additives if so desired. Suitable lubricant additives include those selected from the group consisting of polytetrafluoroethylene (PTFE), hexagonal boron nitride (hBN), flake graphite, molybdenum disulfide ($MoS_2$) and other commonly known fluoropolymeric, dry or polymeric lubricants, and mixtures thereof. The lubricant additive is used to provide an added degree of low friction and wear resistance to the elastomeric component of the composite material that is placed in contact with a rotating surface. A preferred lubricant additive is hBN manufactured by Advanced Ceramics identified as Grade HCP, having an average particle size in the range of from about five to ten micrometers. hBN is a preferred lubricant additive because it provides a superior degree of lubrication when placed in contact with steel without producing harmful, e.g., abrasive, side effects to the journal or cone.

Journal seals constructed according to principles of this invention preferably comprise up to about 20 percent by volume lubricant additive. A seal construction comprising greater than 20 percent by volume of the lubricant additive is not desired because it could interfere with or adversely affect desired mechanical properties of the elastomer material. A particularly preferred seal construction comprises approximately ten percent by volume lubricant additive.

Composite journal seals are constructed, according to principles of this invention, by dissolving a desired quantity of the selected uncured (liquid) elastomeric material in a suitable solvent. Solvents useful for dissolving the elastomeric material include those organic solvents that are conventionally used to dissolve rubber or elastomeric materials.

A desired quantity of lubricant additive is added to the elastomer mixture. The desired nonelastomeric polymeric material is then added to the dissolved elastomeric material so that it is completely immersed in and saturated by the elastomeric material. In an exemplary embodiment, the polymeric material is in the form of a fabric sheet that is placed into contact with the elastomeric material so that the sheet is completely impregnated with the elastomeric material. Preferably, the polymeric fabric sheet is impregnated with the elastomeric material by a calendaring process where the fabric sheet is fed between two oppositely positioned rotating metal rolls that are brought together to squeeze the fabric. The rolls are configured to contain a bank of the elastomeric mixture, which is forced into the fabric weave under pressure. The metal rolls are also heated to soften the elastomeric material and, thereby improve its penetration into the fabric.

The total number of polymeric fabric sheets that are used, and that are impregnated or saturated with the elastomeric material, depends on the desired build thickness of the composite material portion of the seal. If one long fabric sheet is impregnated, the sheet is cut and stacked one on top of another to build a desired seal thickness. Alternatively, a number of shorter sheets can be impregnated, which are then stacked on top of one another. The exact number of sheets that are stacked to form a desired seal thickness depend on such factors as the type and thickness of the particular polymeric fabric that is used, as well as the particular seal construction. For example., in one embodiment, the seal can be constructed entirely from the composite seal material, in which case the desired thickness of composite material for the seal would be approximately the radial thickness of the seal itself. In another embodiment, however, the seal can be constructed having only a portion formed from the composite material, in which case the desired thickness of the composite material for the seal would be approximately the radial thickness of the designated composite portion.

In the case where the seal is formed entirely from the composite material, the impregnated fabric sheets are stacked to a desired seal radial thickness and are wound into a cylinder having an inside and outside diameter roughly equaling that of the final seal ring. The axial ends of the sheets are cut so that the seal ring has an axial thickness roughly equaling that of the final seal ring. The cut ends are sewn together to form a closed loop. The sewn sheets, now roughly in the form of the seal ring, are loaded into a compression mold and the mold is heated to simultaneously form the seal and cure or vulcanize the elastomeric mixture. Cross linking the elastomeric material during cure forms a seal construction made up of polymeric fabric that is strongly entrapped and bonded within the elastomeric medium.

In the case where only a portion of the seal, is formed from the composite material, e.g., a dynamic seal surface located along the inside diameter of the seal, the polymeric sheets are stacked and wound to provide the approximate radial thickness of the desired dynamic seal surface. The axial ends of the stacked sheets are cut to the approximate axial thickness of the seal ring and the cut ends are sewn to form a closed loop. The sewn sheets, now roughly in the form of the dynamic seal surface, are placed into a portion of the mold that forms the dynamic seal surface, i.e., about an inside diameter of the mold. Uncured elastomeric material is loaded into the remaining portion of the mold, e.g., between the stacked sheets and the outside diameter of the mold, and the mold is heated and pressurized to simultaneously form the seal and cure or vulcanize both the elastomeric mixture impregnating the fabric and the added elastomeric material. During the cure process, the elastomeric mixture in the polymeric fabric undergoes cross-linking reactions with itself to entrap the polymeric fabric within the elastomeric medium, and the added elastomeric material undergoes cross-linking reactions with itself.

It is desired that the elastomeric material that is added to form the noncomposite portion of the seal construction be the same as, or be chemically compatible with, the elastomeric mixture used to impregnate the polymeric fabric so that during the cure process the elastomeric mixture and elastomeric material undergo cross-linking reactions with each other to form a seal comprising both composite and noncomposite materials that are homogeneously bonded together.

The completed journal seal is placed into position in the seal cavity of the rock bit with its static seal surface positioned adjacent a static seal surface of the cavity and with the dynamic seal surface placed adjacent a dynamic seal surface of the cavity.

Referring to FIG. 3, a first journal seal embodiment 44 constructed according to principles of this invention is formed exclusively from the composite seal material 52 comprising the polymeric fabric impregnated with the elastomeric material, and having the lubricant additive uniformly distributed within the elastomeric material. Although the seal illustrated in FIG. 3 is configured in the form of an O-ring, having a symmetric cross section comprising a cylindrical dynamic seal surface about an inside diameter, and a cylindrical static surface about an outside diameter, it is to be understood that seals constructed according to principles of this invention formed entirely from the composite material can be configured differently than that illustrated, e.g., having a high aspect ratio, i.e., having an axial thickness that is less than its radial thickness, or having other symmetric or asymmetric cross-sectional geometries.

Seals of this invention can be formed either entirely from the composite material, or partially from the composite material. Generally, to enhance the wear resistance and temperature resistance of the seal it is desired that at least a portion of the wear surface of the seal, e.g., the dynamic seal surface, be formed from the composite material. It is to be understood that the location of the seal wear surface will depend on the configuration of the rock bit journal and cone and, for example can be located along the seal inside diameter, the seal outside diameter, or between the seal inside and outside diameter.

For example, referring to FIG. 4, a second seal embodiment 54 designed for use with the first rock bit embodiment of FIG. 2 is formed having a portion of the seal body 56, comprising a static seal surface 58 positioned along an outside diameter of the seal body, formed from an elastomeric material 60, and having another portion of the seal body 56, comprising a wear or dynamic seal surface 62 positioned along an inside diameter of the seal body, formed entirely from the composite seal material 64 of this invention.

An advantage of the second seal embodiment, formed from both composite and noncomposite materials, is that each seal surface is tailored to provide properties of wear resistance, elasticity, friction resistance, high-temperature endurance and stability that are best suited to meet the operating conditions at the different interfacing rock bit locations. For example, using the composite material to form the dynamic seal surface provides properties of enhanced wear resistance, friction resistance, and high-temperature endurance and stability where it is needed most, i.e., at the rotary surface. Using the noncomposite elastomeric material to form the static seal surface is desired because it provides the desired degree of deformation and friction needed to energize the seal and prevent the static seal surface from moving against an adjacent stationary surface.

Although the second seal embodiment is illustrated having a dynamic seal surface formed from the composite material, it is understood that the composite material can be used to form any portion of the seal where increased properties of wear resistance, friction resistance and the like are desired. Additionally, it to be understood that although the second seal embodiment is illustrated configured in the form of an O-ring, other symmetrical and asymmetrical cross-sectional seal geometries are understood to be within the scope of this invention.

Referring to FIG. 5, a third seal embodiment 66 has a seal body 68 comprising a static seal surface 70 formed from an elastomeric material 72, a dynamic seal surface 76 formed from the composite material 74, and having an asymmetric cross-sectional seal geometry. Specifically, the third seal embodiment comprises a dynamic seal surface 76 that has a larger radius of curvature than that of the static seal surface 70 for purpose of optimizing operation of the seal at each adjacent rotating and stationary surface, respectively. This is but one example of a seal that is constructed having an asymmetric cross-sectional seal geometry and being constructed from both the composite material and a noncomposite material. It is understood that seals of this invention are also intended to be used with such other asymmetric seal constructions as lip seals and the like, where at least a portion of the wear surface is formed from the composite material.

As discussed above, it is desired that the elastomeric material used to form the static seal surface be the same as or be compatible with the elastomeric material selected to form the composite material to provide a strong bond therebetween.

Referring to FIG. 6, an alternative second seal embodiment 78 has a seal body 80 comprising a static seal surface 82 formed from an elastomeric material 84, a dynamic seal surface 86 formed from the composite material 88 of this invention, and having a symmetric cross-sectional seal geometry. Unlike the second seal embodiment illustrated in FIG. 4, the alternative second seal embodiment comprises a dynamic seal surface 86 that is only partially formed from the composite material 88. Such alternative embodiment may be useful in particular applications where it is desirable to tailor the dynamic sealing surface to have different properties of wear resistance, high-temperature endurance and stability, and a reduced coefficient of friction therealong. For example, it may be desirable to form a first section of the dynamic sealing surface immediately adjacent the lubricated bearing surface from a non-composite elastomeric composition, to take advantage of its particular physical properties, and form a second section of the dynamic sealing surface removed from the lubricated bearing surface from the composite material, to take advantage of its related improved physical properties.

Referring to FIG. 7, an alternative third seal embodiment 90 has a seal body 92 comprising a static seal surface 94 formed from an elastomeric material 96, a dynamic seal surface 98 formed from the composite material 100 of this invention, and having an asymmetric cross-sectional seal geometry. Unlike the third seal embodiment illustrated in FIG. 5, the alternative third seal embodiment comprises a dynamic seal surface 98 that is only partially formed from the composite material 100. As previously discussed for the alternative second seal embodiment, such alternative third seal embodiment may be useful in particular applications where improved wear resistance, high-temperature endurance and stability, and a reduced coefficient of friction is desired only along a portion of the dynamic seal surface.

Figure 8:
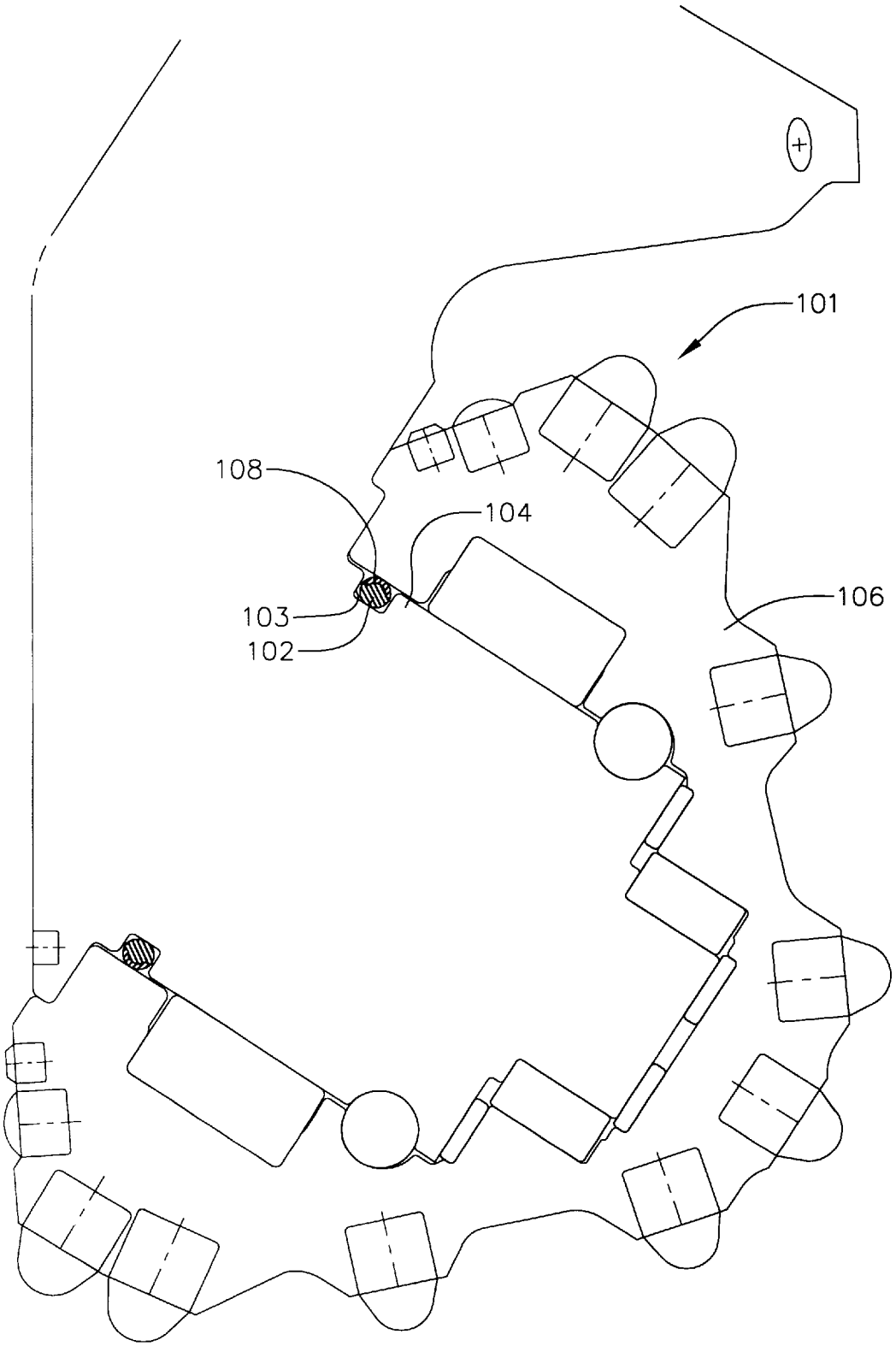
FIG. 8 is a partial cross-section view of a second rock bit embodiment comprising a journal seal constructed according to principals of this invention.

FIG. 8 illustrates a second embodiment rock bit 101 that comprises a single journal seal 102 constructed according to principals of this invention, that is disposed within a seal cavity 103 that is formed within the journal 104 surface rather than within the cone 106 as illustrated in FIG. 2. The journal seal 102 for this application is constructed having a dynamic seal surface 108 along an outside diameter of the seal that is formed from the composite materials discussed above, and having a body and remaining portion of the seal formed from an elastomeric material.

Figure 9:
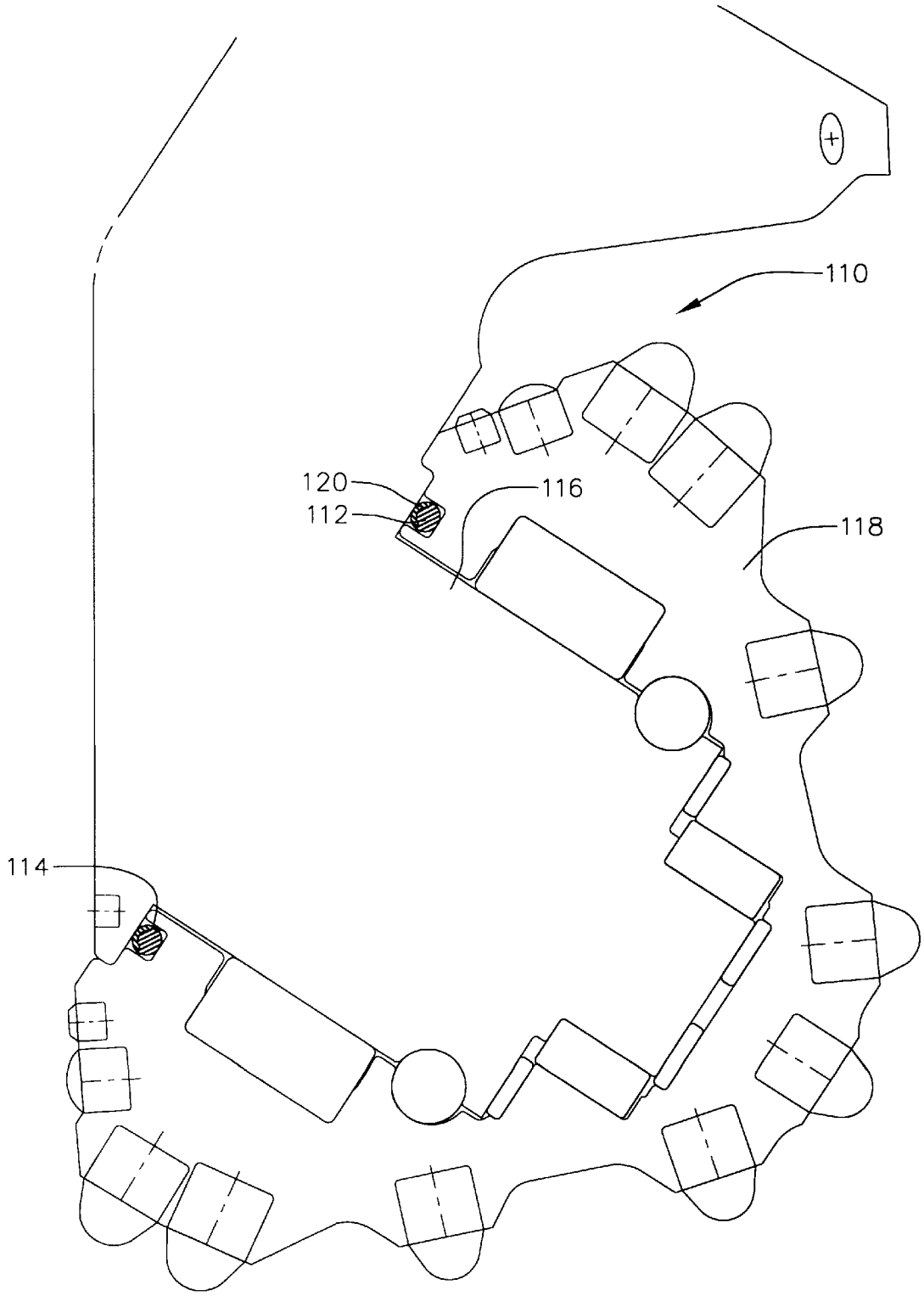
FIG. 9 is a partial cross-section view of a third rock bit embodiment comprising a journal seal constructed according to principals of this invention.

FIG. 9 illustrates a third embodiment rock bit 110 that comprises a single journal seal 112, constructed according to principals of this invention, that is disposed within a seal cavity 114 that is formed within an axially facing surface of the cone 118. The journal seal 112 for this application is constructed having a dynamic seal surface 120 along an axial surface of the seal that is formed from the composite materials discussed above, and having a body and remaining portion of the seal formed from an elastomeric material.

Although journal seals of this invention have been described above and illustrated for application in a earth boring bit comprising a single seal, i.e., a positive or absolute seal, to provide a leak-tight seal between the journal and cone, journal seals of this invention can also be used with earth boring bits that have more than one seal. For example, journal seals of this invention can be used as a secondary seal to minimize or prevent the ingress of drilling debris and the like towards a separate primary journal seal. In such secondary seal application, the journal seal can act as an excluder seal to minimize the amount of drilling debris that migrates to the primary seal to reduce the destructive and erosive effects that the passage of such debris, if left uncontrolled, would have on the primary seal.

Journal seals of this invention, when used in such secondary seal applications, have exhibited improved properties wear resistance, temperature resistance, and temperature stability when compared to conventional all elastomeric seals. The improved properties thus mentioned enable the secondary seal to both provide both a greater degree and longer duration of protection to the primary seal, thereby extending the useful service life of the earth boring bit. Depending on the particular application, journal seals of this invention can be used as both the primary seal and the secondary seal. U.S. patent application Ser. No. 08/574,793 describes one such application for a dual seal rotary cone rock bit, which is incorporated herein by reference. Also incorporated herein by reference is U.S. Pat. No. 6,033,117 and U.S. patent application ser. No. 08/980,935 (pending) both being a continuation-in-part of the above-identified abandoned patent application, that are each filed on Dec. 1, 1997, by Applicant Smith International, Inc., and that are entitled "Sealed Bearing Drill Bit with Dual-Seal Configuration" and "Sealed Bearing Drill Bit with Dual-Seal Configuration and Fluid Cleaning Capability."

Figure 10:
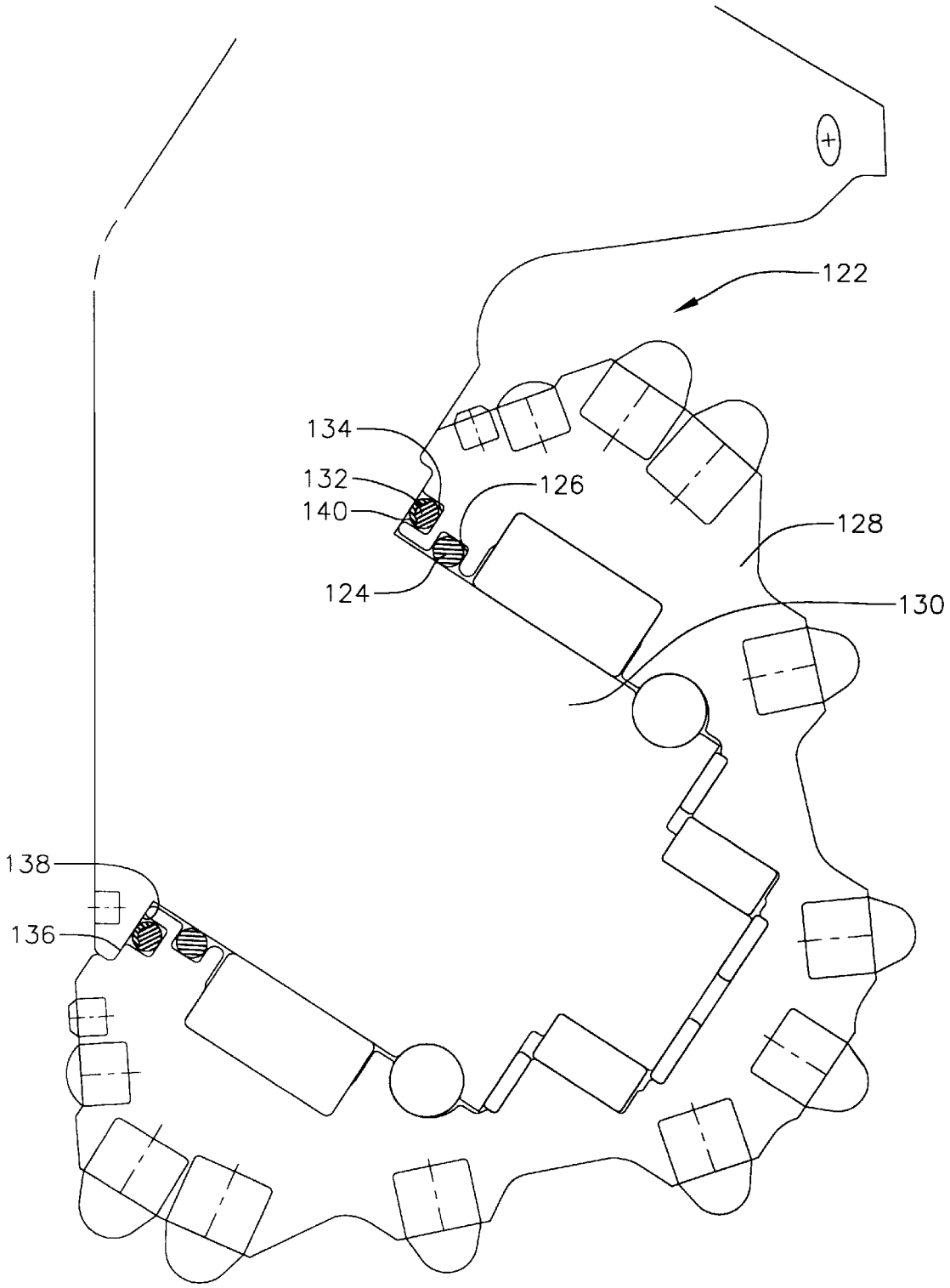
FIG. 10 is partial cross-section view of a fourth rock bit embodiment having a dual seal arrangement comprising a journal seal constructed according to principals of this invention.

FIG. 10 illustrates a fourth embodiment rock bit 122 having a dual seal arrangement. The bit comprises a first or primary journal seal 124 that is disposed within a first seal cavity 126 formed radially in the cone 128. The primary journal seal 124 can be formed from conventional elastomeric materials to provide an absolute seal against the journal 130 and cone 128. A secondary journal seal 132, constructed according to principles of this invention, is disposed within a second seal cavity 134 formed axially within the cone 128. The secondary journal seal 132 is interposed between adjacent axially facing surfaces of the cone 136 and leg 138 to minimize or prevent the ingress of drilling debris therebetween and axially onward toward the primary seal 124.

The secondary journal seal 132 for this application is constructed having a dynamic seal surface 140 along an axial seal surface that is formed from the composite materials discussed above, and having a body and remaining portion of the seal formed from an elastomeric material.

Figure 11:
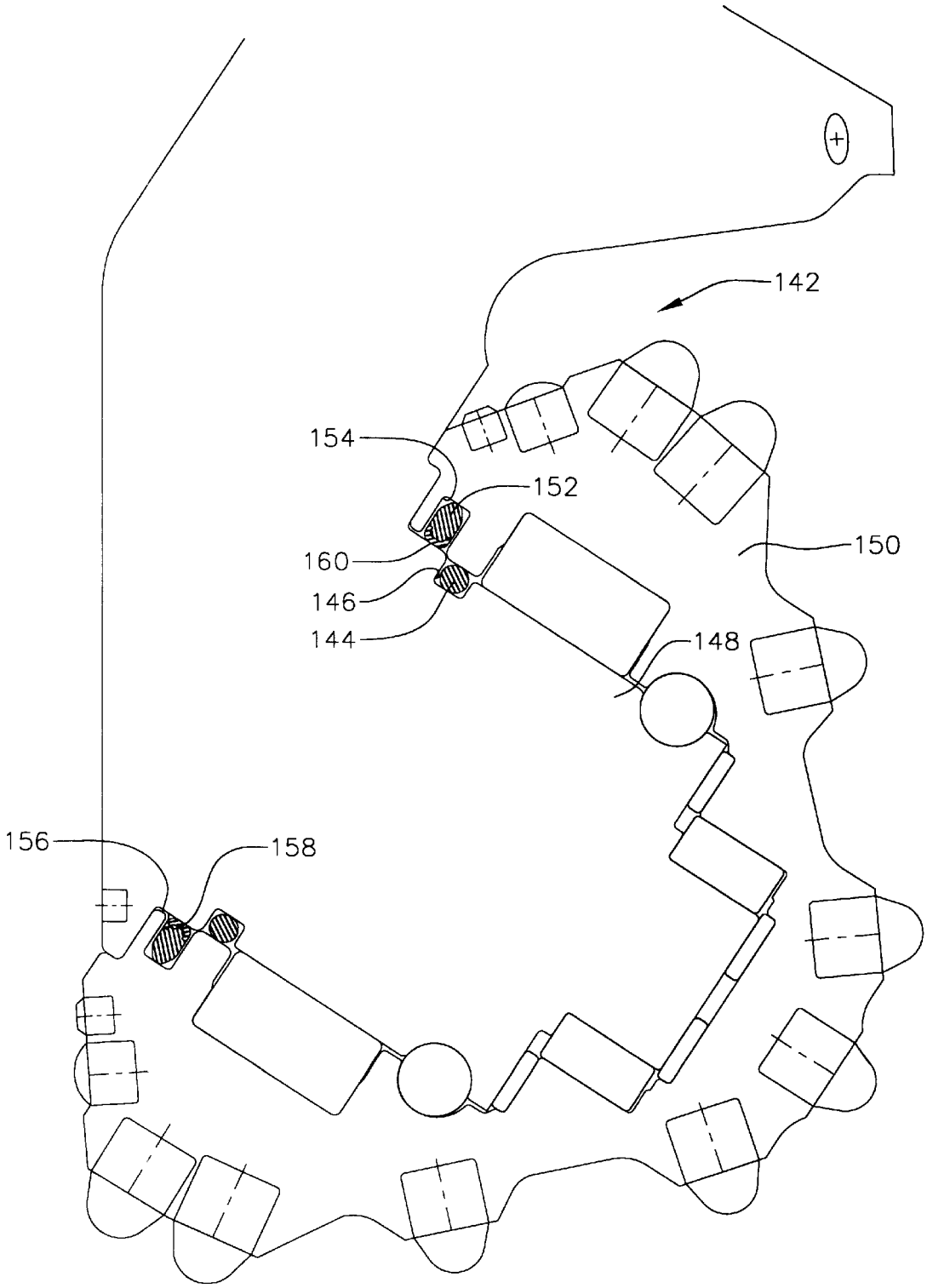
FIG. 11 is partial cross-section view of a fifth rock bit embodiment having a dual seal arrangement comprising a journal seal constructed according to principals of this invention.

FIG. 11 illustrates a fifth embodiment rock bit 142 having a dual seal arrangement. The bit comprises a primary journal seal 144 that is disposed within a first seal cavity 146 formed radially in the journal 148. The primary journal seal 144 is formed from conventional elastomeric materials to provide an absolute seal between the journal 148 and cone 150. A secondary journal seal 152, constructed according to principles of this invention, is disposed within a second seal cavity 154 formed radially within the cone 150. The secondary journal seal 152 is interposed between adjacent radially facing surfaces of the cone 156 and journal 158 to minimize or prevent the ingress of drilling debris therebetween and axially onward toward the primary seal 144.

The secondary journal seal 152 for this application is constructed having a dynamic seal surface 160 along an inside diameter seal surface (as better illustrated in FIG. 5) that is formed from the composite materials discussed above, and having a body and remaining portion of the seal formed from an elastomeric material. Although the secondary journal seal 152 is illustrated having an asymmetric radial cross sectional geometry, it is understood that the secondary journal seal for such application can have a symmetric cross sectional geometry, e.g., in the shape of an O-ring as illustrated in FIG. 4.

Figure 12:
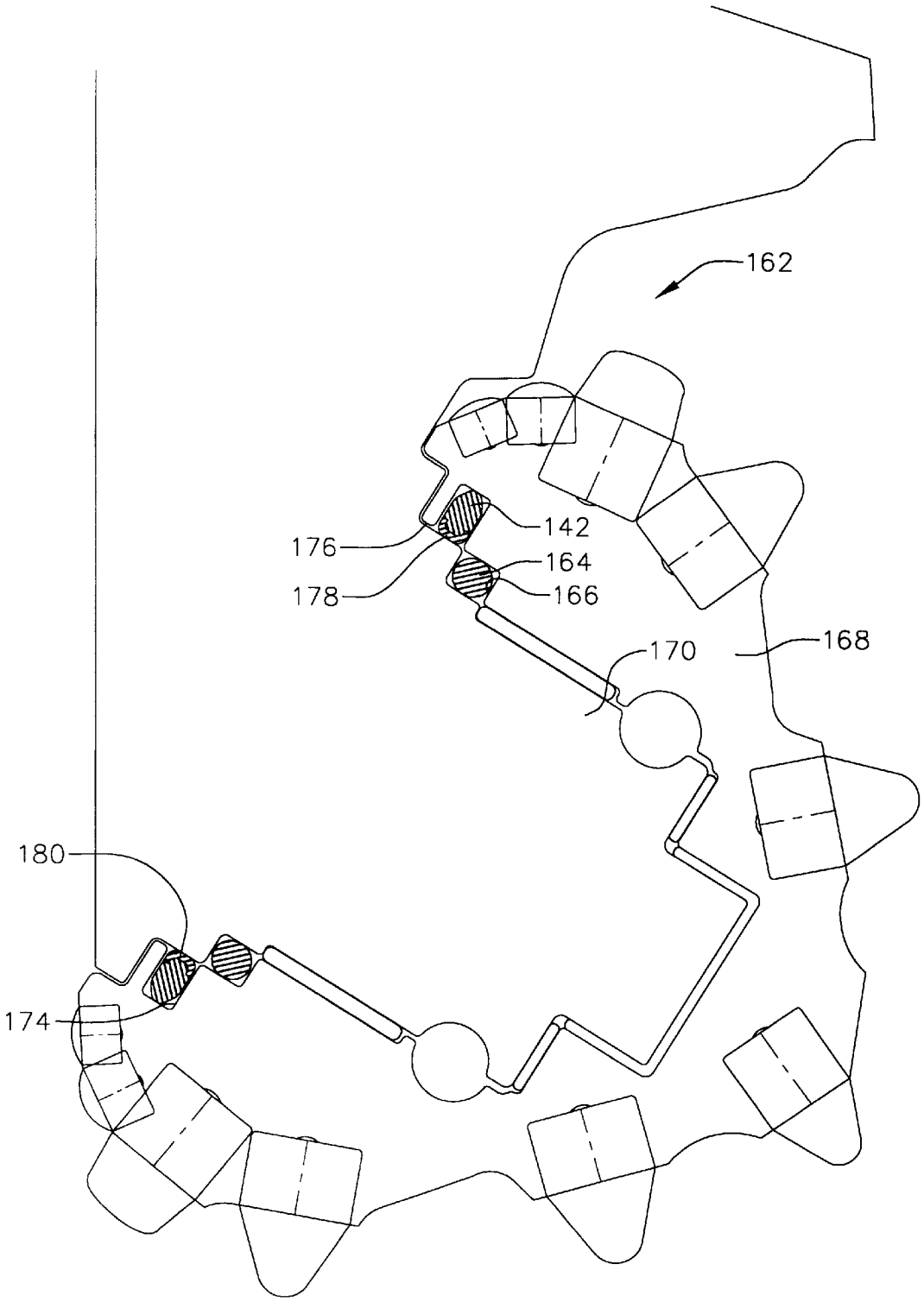
FIG. 12 is partial cross-section view of a sixth rock bit embodiment having a dual seal arrangement comprising a journal seal constructed according to principals of this invention.

FIG. 12 illustrates a sixth embodiment rock bit 162 having a dual seal arrangement. The bit comprises a primary journal seal 164 that is disposed within a first seal cavity 166 formed radially between adjacent cone 168 and journal 170 surfaces. The primary journal seal 164 is formed from conventional elastomeric materials to provide an absolute seal against the journal and cone. A secondary journal seal 172, constructed according to principles of this invention, is disposed within a second seal cavity 174 formed radially within the cone 168. The secondary journal seal 172 is interposed between adjacent radially facing surfaces of the cone 168 and journal 170 to minimize or prevent the ingress of drilling debris therebetween and axially onward toward the primary seal 164.

The secondary journal seal 172 for this application is constructed having a dynamic seal surface 180 along an inside diameter seal surface (as better illustrated in FIG. 5) that is formed from the composite materials discussed above, and having a body and remaining portion of the seal formed from an elastomeric material. Although the secondary journal seal 172 is illustrated having an asymmetric radial cross sectional geometry, it is understood that the secondary journal seal for such application can have a symmetric radial cross sectional geometry, e.g., in the shape of an O-ring as illustrated in FIG. 4.

Figure 13:
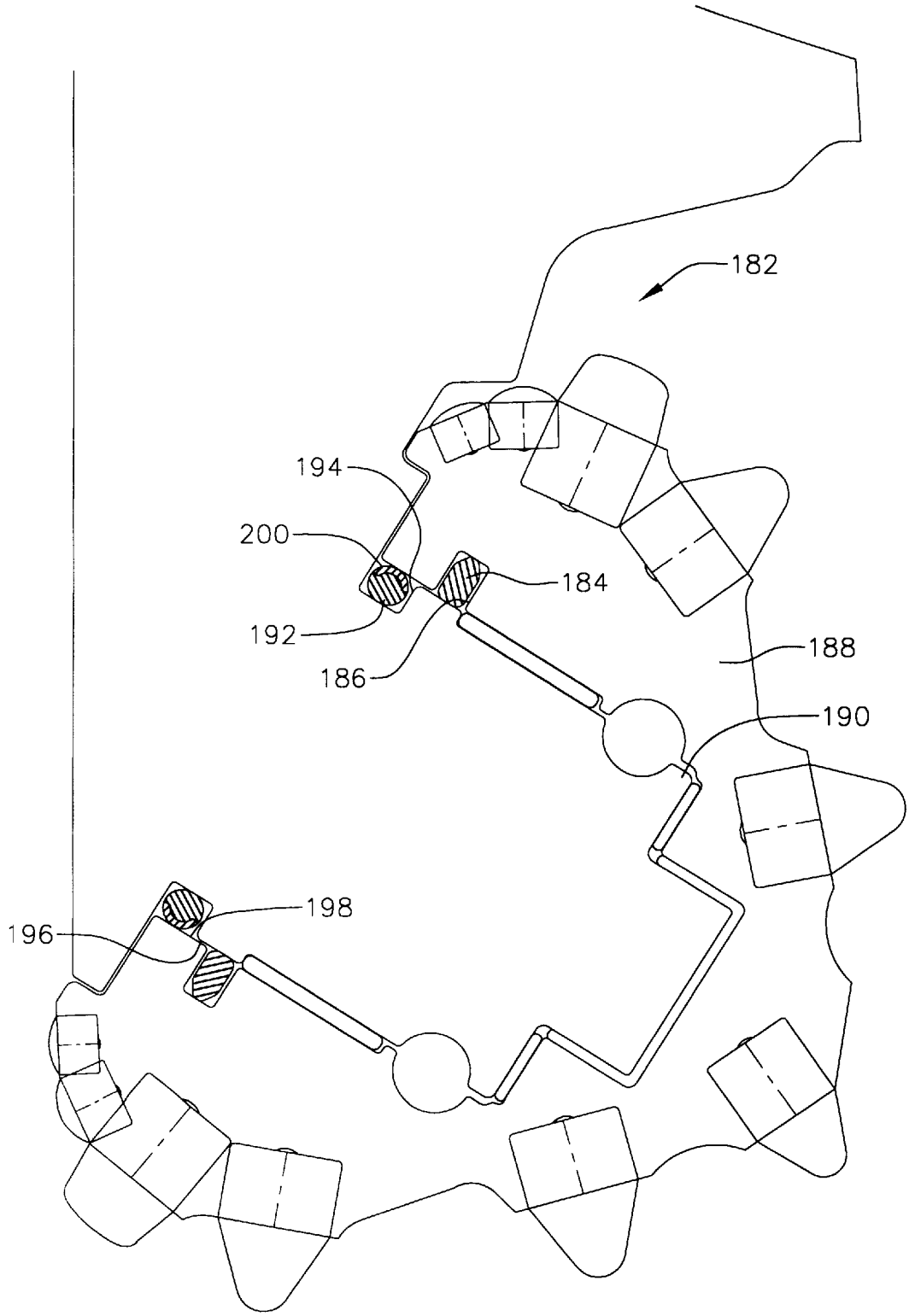
FIG. 13 is partial cross-section view of a seventh rock bit embodiment having a dual seal arrangement comprising a journal seal constructed according to principals of this invention.

FIG. 13 illustrates a seventh embodiment rock bit 182 having a dual seal arrangement. The bit comprises a primary journal seal 1 84 that is disposed within a first seal cavity 186 formed radially within the cone 188. The primary journal seal 184 is formed from conventional elastomeric materials to provide an absolute seal against the journal and cone. A secondary journal seal 192, constructed according to principles of this invention, is disposed within a second seal cavity 194 formed radially within the journal 190. The secondary journal seal 192 is interposed between adjacent radially facing surfaces of the cone 196 and journal 198 to minimize or prevent the ingress of drilling debris therebetween and axially onward toward the primary seal 184.

The secondary journal seal 192 for this application is constructed having a dynamic seal surface 200 along an outside diameter seal surface that is formed from the composite materials discussed above, and having a body and remaining portion of the seal formed from an elastomeric material. Although the secondary journal seal 192 is illustrated having a symmetric radial cross sectional geometry, it is understood that the secondary journal seal for such application can have an asymmetric radial cross sectional geometry.

Figure 14:
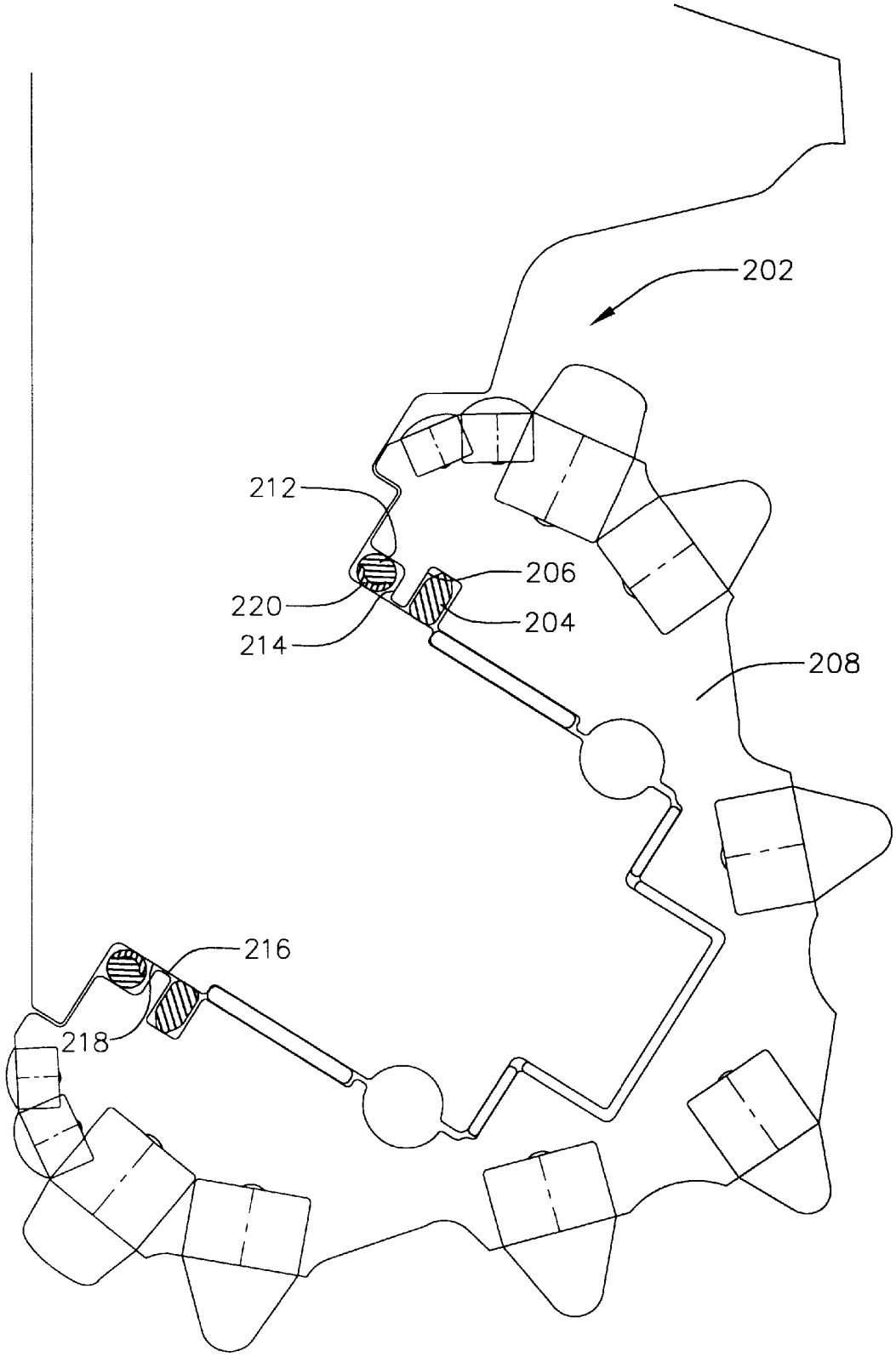
FIG. 14 is partial cross-section view of a eighth rock bit embodiment having a dual seal arrangement comprising a journal seal constructed according to principals of this invention.

FIG. 14 illustrates an eighth embodiment rock bit 202 having a dual seal arrangement. The bit comprises a primary journal seal 204 that is disposed within a first seal cavity 206 formed radially within the cone 208. The primary journal seal 204 is formed from conventional elastomeric materials to provide an absolute seal against the journal and cone. A secondary journal seal 212, constructed according to principles of this invention, is disposed within a second seal cavity 214 also formed radially within cone 208. The secondary journal seal 212 is interposed between adjacent radially facing surfaces of the cone 216 and journal 218 to minimize or prevent the ingress of drilling debris therebetween and axially onward toward the primary seal 204.

The secondary journal seal 212 for this application is constructed having a dynamic seal surface 220 along an inside diameter seal surface (similar to that illustrated in FIG. 4) that is formed from the composite materials discussed above, and having a body and remaining portion of the seal formed from an elastomeric material. Although the secondary journal seal 212 is illustrated having a symmetric radial cross sectional geometry, it is understood that the secondary journal seal for such application can have an asymmetric radial cross sectional geometry as illustrated in FIG. 5, for example.

Figure 15:
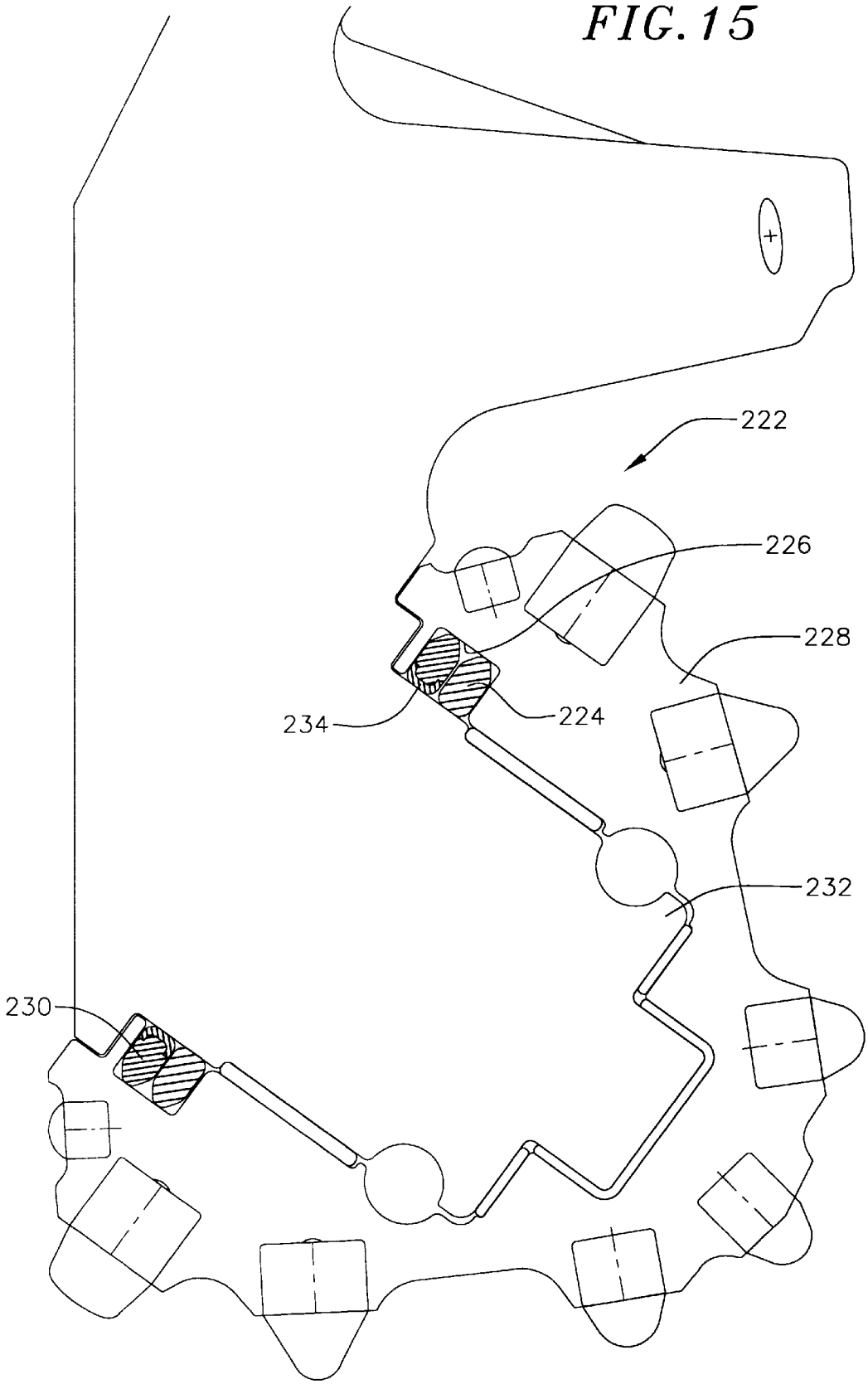
FIG. 15 is partial cross-section view of a ninth rock bit embodiment having a dual seal arrangement comprising a journal seal constructed according to principals of this invention.

FIG. 15 illustrates a ninth embodiment rock bit 222 having a dual seal arrangement. The bit comprises a primary journal seal 224 that is disposed within a tandem seal cavity 226 formed radially within the cone 228. The primary journal seal 224 is formed from conventional elastomeric materials to provide an absolute seal against the journal and cone. A secondary journal seal 230, constructed according to principles of this invention, is also disposed within the tandem seal cavity 226 axially adjacent to the primary journal seal 224. The secondary journal seal 230 is interposed between adjacent radially facing surfaces of the cone 228 and journal 232 to minimize or prevent the ingress of drilling debris therebetween and axially onward toward the axially adjacent primary journal seal 224.

The secondary journal seal 230 for this application is constructed having a dynamic seal surface 234 along an inside diameter seal surface (similar to that illustrated in FIG. 5) that is formed from the composite materials discussed above, and having a body and remaining portion of the seal formed from an elastomeric material. Although both the primary and secondary journal seals are illustrated having an asymmetric radial cross sectional geometry, it is understood that these seals can have a symmetric cross sectional geometry as illustrated in FIG. 4, for example.

While each of the above-identified dual journal seal rock bit embodiments have been described and illustrated as having a primary journal seal formed from an entirely elastomeric composition, it is to be understood that the primary journal seal for such dual seal application can also be constructed according to principles of this invention being formed at least partially from the composite material.

Although, limited embodiments of high performance journal seals for rock bits have been described and illustrated herein, many modifications and variations will be apparent to those skilled in the art. For example, although the journal seal has been described and illustrated for use with rock bits, it is to be understood that journal seals constructed according to principles of this invention can also be used with other bits, such as drill bits, mining bits or the like. It should also be understood that although a secondary seal may be constructed as stated above within the bounds of the invention, the primary seal is not limited to an O-ring type seal, but may be another type of seal such as Belleville seals, metal face seals, lip seals, and other seal types known in the art.

Accordingly, it is to be understood that within the scope of the appended claims, that high performance journal seals according to principles of this invention may be embodied other than as specifically described herein.

What is claimed is:

1. A journal seal for use in a rotary cone rock bit comprising:

an annular body having a dynamic seal surface and a static seal surface, wherein at least a portion of the dynamic seal surface is formed from a composite material comprising an arrangement of nonelastomeric polymeric material in the form of at least one fabric sheet bonded together with an elastomeric material, the fabric being positioned along a wear surface of the dynamic seal surface.

2. The journal seal as recited in claim 1 wherein the seal body, static seal surface, and dynamic seal surface are each formed from the composite material.

3. The journal seal as recited in claim 1 wherein a remaining portion of the seal is formed from an elastomeric material that is chemically compatible with the elastomeric material used to form the composite material.

4. The journal seal as recited in claim 1, wherein the composite material further comprises a lubricant additive distributed throughout the elastomeric material.

5. The journal seal as recited in claim 4 wherein the lubricant additive is selected from the group consisting of polymeric materials, graphite, hexagonal boron nitride, molybdenum disulfide, and mixtures thereof.

6. The journal seal as recited in claim 4 wherein the elastomeric material comprises up to about 20 percent by volume lubricant additive.

7. The journal seal as recited in claim 1 wherein the nonelastomeric polymeric material is selected from the group of nonelastomeric polymeric materials consisting of polybenzimidazoles, poly m-phenylene isophthalamide, polyester, cotton, asbestos, and combinations thereof.

8. The journal seal as recited in claim 7 wherein the composite material comprises repeating layers of nonelastomeric polymeric fabric sheet bonded together with the elastomeric material.

9. The journal seal as recited in claim 1 wherein the composite material comprises in the range of from about 20 to 80 percent by volume nonelastomeric polymeric material.

10. A rotary cone rock bit for drilling subterranean formations comprising;

a bit body including at least one leg, the leg including a journal pin and having a first sealing surface;

a cutter cone rotatably mounted on the leg and having a second sealing surface;

a primary annular seal interposed between the first and second sealing surfaces to form a dynamic seal between the cone and leg while the cone is rotating; and a secondary annular seal interposed between the first and second sealing surfaces to form a dynamic seal between the cone and leg while the cone is rotating to exclude debris from reaching the primary seal, the secondary seal having a wear surface that is at least partially formed from a composite material comprising an elastomeric component and a nonelastomeric polymeric component, the nonelastomeric polymeric component being in the form of a fabric.

11. The rotary cone rock bit as recited in claim 10 wherein the secondary annular seal includes a body that is formed from an elastomeric material, and wherein the elastomeric material of the body is bonded to the elastomeric component of the composite material.

12. The rotary cone rock bit as recited in claim 10 wherein the secondary annular seal includes a static seal surface that is formed from an elastomeric material.

13. The rotary cone rock bit as recited in claim 10 wherein the secondary annular seal includes a static seal surface that is formed from the composite material.

14. The rotary cone rock bit as recited in claim 10 wherein the fabric is formed from an arrangement of fibers, the fibers being selected from the group consisting of aromatic polyamines, polybenzimidazoles, poly m-phenylene isophthalamide, polyester, cotton, asbestos, and combinations thereof.

15. The rotary cone rock bit as recited in claim 10 wherein the fabric is the form of a sheet formed from an arrangement of fibers, and wherein the composite material comprises repeating sheets that are bonded together with the elastomeric component.

16. The rotary cone rock bit as recited in claim 10 wherein the composite materials used to form the secondary annular seal further comprises one or more lubricant additives distributed throughout the elastomeric component.

17. The rotary cone rock bit as recited in claim 16 wherein the lubricant additive is selected from the group consisting of polymeric materials, graphite, hexagonal boron nitride, molybdenum disulfide, and mixtures thereof.

18. The rotary cone rock bit as recited in claim 10 wherein the primary annular seal is radially energized between the cone and journal pin, and wherein the secondary annular seal is axially energized between the cone and leg.

19. The rotary cone rock bit as recited in claim 10 wherein the primary annular seal and secondary annular seal are each radially energized between the cone and journal pin.

20. A earth boring rotary bit for drilling subterranean formations comprising:

a bit body having at least one leg, the leg including a journal pin and having a first sealing surface;

a cutter cone rotatably mounted on the leg and including a second sealing surface;

a lubricated bearing interposed between the leg and cone;

a first annular seal interposed between the cone and the leg adjacent the lubricated bearing for retaining lubricant in the bearing;

a second annular seal interposed between the cone and the leg and positioned axially adjacent a side of the first annular seal that is opposite the bearing, the second annular seal having a body with a first sealing surface and a second sealing surface, one of the first or second sealing surfaces forming a dynamic seal between the cone and leg to exclude debris from reaching the first annular seal, at least a portion of the one of the first or second sealing surfaces forming the dynamic seal being formed from a composite material comprising a nonelastomeric polymeric material bonded with an elastomeric material, the other of the first or second sealing surface being formed from an elastomeric material, wherein the elastomeric materials used to form the first and second sealing surface are chemically compatible to form a bond therebetween, and wherein the nonelastomeric polymeric material comprises fibers arranged to form a fabric.

21. The rotary cone rock bit as recited in claim 20 wherein the elastomeric material used to form the composite material comprises a lubricant additive.

22. The rotary cone rock bit as recited in claim 20 wherein the composite material comprises in the range of from about 20 to 80 percent by volume of the nonelastomeric polymeric material.

23. The rotary cone rock bit as recited in claim 22 wherein the composite material comprises in the range of from about 30 to 70 percent by volume of the nonelastomeric polymeric material.

24. The rotary cone rock bit as recited in claim 20 wherein the first annular seal is radially energized between the cone and journal pin, and wherein the second annular seal is axially energized between the cone and leg.

25. The rotary cone rock bit as recited in claim 20 wherein the first and second annular seals are each radially energized between the cone and journal pin.

26. The rotary cone rock bit as recited in claim 20 wherein the fibers are selected from the group consisting of aromatic polyamines, polybenzimidazoles, poly m-phenylene isophthalamide, polyester, cotton, asbestos, and combinations thereof.

27. The rotary cone rock bit as recited in claim 26 wherein the fabric is in the form of a sheet, and wherein the composite material comprises repeating sheets that are bonded together with the elastomeric component.

28. The rotary cone rock bit as recited in claim 20 wherein the composite material further comprises one or more lubricant additives distributed throughout the elastomeric material.

29. A rotary cone rock bit as recited in claim 28 wherein the lubricant additive is selected from the group consisting of polymeric materials, graphite, hexagonal boron nitride, molybdenum disulfide, and mixtures thereof.

30. A rotary cone rock bit for drilling subterranean formations comprising;

a bit body including at least one leg, the leg including a journal pin;

a cutter cone rotatably mounted on the leg;

a first annular seal interposed between the leg and cone to form a dynamic seal therebetween while the cone is rotating; and a second annular seal interposed between the leg and cone to prevent debris from reaching the first seal during operation of the bit, the second seal having a wear surface formed from a composite material comprising an elastomeric component and a fabric nonelastomeric polymeric component.

31. The rock bit as recited in claim 30 wherein the fabric is positioned along the wear surface to provide resistance to wear from contact against an adjacent rotary rock bit leg or cone surface.

32. The rock bit as recited in claim 30 wherein the first annular seal is interposed radially between the cone and journal pin.

33. The rock bit as recited in claim 32 wherein the second annular seal is interposed axially between the cone and leg.

34. The rock bit as recited in claim 32 wherein the second annular seal is interposed radially between the cone and journal pin.

* * * * *